United States Patent [19]

Darling

[11] 4,020,731

[45] May 3, 1977

[54] METHOD OF SECURING HAIR TO A MUSICAL INSTRUMENT BOW

[76] Inventor: Myron E. Darling, 515 Ohio St., Webster City, Iowa 50595

[22] Filed: July 31, 1975

[21] Appl. No.: 600,734

Related U.S. Application Data

[62] Division of Ser. No. 489,822, July 18, 1974, Pat. No. 3,919,912.

[52] U.S. Cl. ..... 84/282
[51] Int. Cl.[2] ..... G10D 1/02
[58] Field of Search ..... 84/282

[56] References Cited

UNITED STATES PATENTS

| | | | |
|---|---|---|---|
| 320,123 | 6/1885 | Franklin et al. | 84/282 |
| 485,038 | 10/1892 | Houlihan | 84/282 |
| 638,508 | 12/1899 | Gregg | 84/282 |
| 828,883 | 8/1906 | Hart | 84/282 |
| 1,327,433 | 1/1920 | Jelinik | 84/282 |
| 2,901,937 | 9/1959 | Galelli | 84/282 |

*Primary Examiner*—Stephen J. Tomsky
*Attorney, Agent, or Firm*—Henderson, Strom & Sturm

[57] ABSTRACT

A frog for a musical instrument bow for clamping the hair of the bow, such that the hair can be clamped to the frog prior to being cut to the proper length, and with the hair being cut while clamped, either before or after the frog is adjusted lengthwise of the bow for proper tautness of the hair.

1 Claim, 4 Drawing Figures

METHOD OF SECURING HAIR TO A MUSICAL INSTRUMENT BOW

This is a divisional application directed to the method disclosed in apparatus patent application Ser. No. 489,822, filed July 18, 1974, and now U.S. Pat. No. 3,919,912.

BACKGROUND OF THE INVENTION

The present invention relates generally to a musical instrument bow, and particularly to the frog unit thereof.

One of the most difficult problems in stringing or restringing a musical instrument bow, such as a violin or the like is the cutting of the hair to the proper length and in attaching the hair to the frog. In contemporary bows, the hair at the frog unit end of the rod is held, for example, within a cavity formed within the frog body such that the end of the hair is jammed or wedged into the cavity, after it is cut to length, by a block and/or glue, or by a comb or the like. As the frog end of the hair to be cut to length prior to the application of the wedge, this step of cutting is a delicate operation which if not accomplished properly can either prevent the appropriate tautness from being obtained, or which can make the attachment of the hair to the frog extremely difficult.

Further, contemporary stringing also requires that after the tip end of the hair is secured, the opposite end of the hair must be held manually or otherwise while it is wrapped and tied by fine thread or the like, then cut, and then dipped into a resin prior to being wedged into the frog.

It is to a marked improvement of these techniques and structures that this invention is directed; for the purpose of providing a more accurate stringing of the bow, and which one person can readily and expeditiously accomplish.

SUMMARY OF THE INVENTION

The present invention relates to a musical instrument bow having a rod, a tip unit at one end of the rod, a frog unit at the other end of the rod and which frog unit is longitudinally movable relative to the tip unit, and hair which is adapted to be held taut between the tip unit and the frog unit. More particularly, the invention comprises an improvement of the frog unit wherein the hair may be held relatively taut, then secured to the frog by a wedging action, and subsequently cut to length after which the frog unit is movable to attain the appropriate tautness of the hair.

An object of this invention is to provide an improved frog unit for a musical instrument bow.

Another object of this invention is to provide a frog unit wherein the hair is secured to the frog unit prior to being cut to length.

Still another object of this invention is to provide a frog unit wherein the hair is accessible in a clamped condition by the frog unit for cutting purposes.

Another object of this invention is to provide a frog unit with a cavity for holding the hair which extends the entire length of the frog such that the hair may be stretched lengthwise of the frog prior to its being wedged into engagement with the frog, and again prior to its being cut to the appropriate length.

A further object of this invention is to provide a frog unit which is effective, efficient and easily manufactured.

Still another object of this invention is to provide a frog unit for a musical instrument bow which is capable of attaining the above designated objectives.

DESCRIPTION OF THE PREFERRED EMBODIMENT

Figure 1:
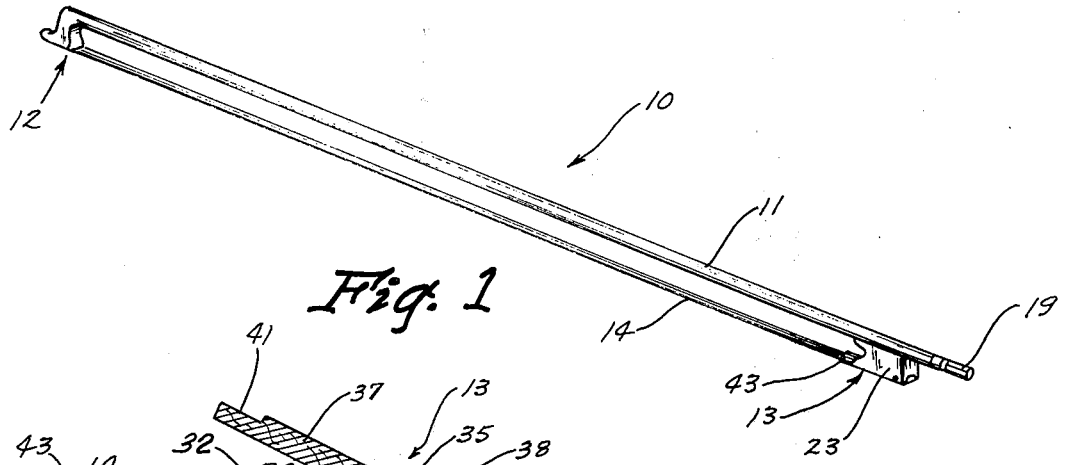
FIG. 1 is a perspective view of a musical instrument bow embodying this invention.

Referring to the drawings, wherein like reference numerals designate identical or corresponding parts throughout the several views, a musical instrument bow is indicated generally at 10 in FIG. 1 and comprises an elongated rod 11, a head or tip unit 12 at the outer end of the rod 11, a movable block or frog unit 13 at the inner end of the rod, and with hair 14 held in an appropriate taut condition between the tip unit 12 and the frog unit 13.

At the frog unit end of the rod 11, an elongated slot 16 (FIG. 2) is formed longitudinally in the end of the rod and through a fitting 17 at the outer end thereof. The slot 16 has an opening 18 in one wall of the rod, and with an elongated thumb screw 19 inserted through the fitting 17 and into the slot 16, a screw threaded stem 21 being found in the slot 16. The outer end 22 of the thumb screw 19 is adapted to abut and rotate against the fitting 17.

Figure 3:
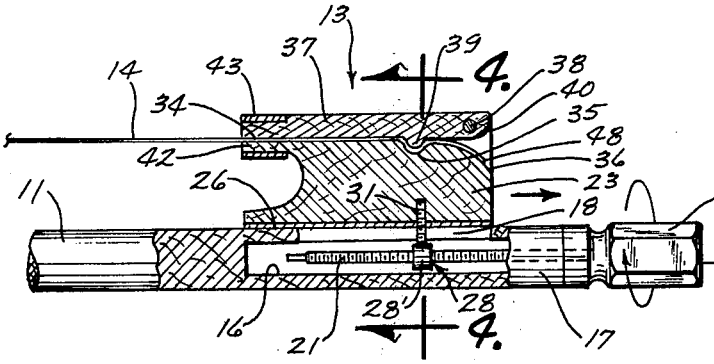
FIG. 3 is a sectional view like FIG. 2, and with the frog unit in an operative condition.

The invention is directed particularly to the frog unit 13 of the bow 10, and which unit includes a frog 23 the body of which is of wood, plastic, metal or other suitable material. The frog 23 has a concave bottom surface 24 as best illustrated in FIG. 4 and which is mounted upon a curved slide 26 of metal or the like and within which is formed a hole 27 (FIGS. 3 and 4).

For holding the stem 21 of the screw 19 in a jack-screw fashion, a knurled screw (FIGS. 2 and 4) is provided, the collar 28 of the screw having a threaded passage 29 (FIG. 4) formed therein for rotatably receiving the stem 21. The screw 28 includes a threaded stud 31 which is inserted into the body of the frog 23 such that the collar 28' is positioned to receive the stem 21 as is best illustrated in FIGS. 3 and 4. This arrangement provides for sliding movement in a lengthwise direction of the frog unit 13 relative to the tip unit 12, and does not form a part of the invention.

The invention is particularly directed to the upper portion of the frog 23 wherein the hair 14 is held by the frog unit 13. For this purpose, a U-shaped cavity 32 is formed the entire length of the frog 23, between walls 33 on either side thereof, and which cavity 32 has a generally flat floor 34 broken toward the rear end thereof by a transverse depression 35, and with the rear end 36 tapering downwardly as is shown best in FIGS. 2 and 3.

Figure 2:
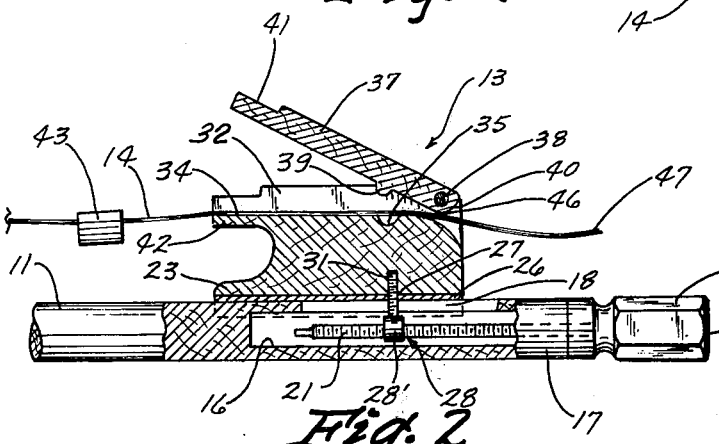
FIG. 2 is an enlarged view of the frog unit end of the bow, partly in section and shown in an inoperative condition, and wherein the bow has been rotated 180° thus placing the frog unit in an upright position.
Figure 4:
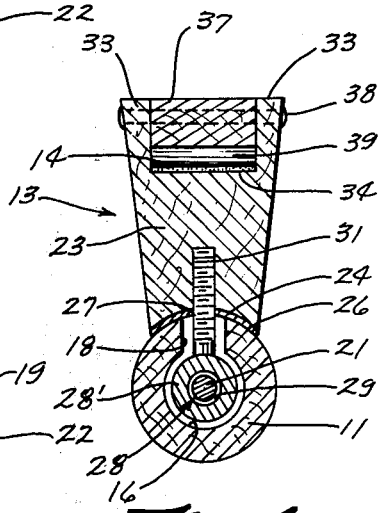
FIG. 4 is an enlarged view taken along the line 4—4 in FIG. 3.

For the purpose of holding the hair 14 in a wedged and therefore tight condition against the frog 23, a plate or cover 37 (FIGS. 2–4) is provided, which cover 37 fits into the cavity 32 as best illustrated in FIG. 4. A pin 38 pivotally connects the rear end of the cover 37 to the opposed walls 33 of the frog 23. The cover has a projection 39 which fits in a complementary manner within the depression 35; and the rear underside 40 of the cover 37 is tapered upwardly and away from the rear end 36 of the frog in the position of the frog unit 13 as is shown in FIGS. 2 and 3. The front end of the cover 37 is cut away at 41 such that when in the closed position of FIG. 3, the cover 37 is securely held to the lip 42 of the frog by a metallic slip ring 43.

In use of the frog unit 13, rotation of the thumb screw 19 moves the frog 23 along the rod 11 to the forward position of FIG. 2. In this position, the cover 37 is then raised, again as illustrated in FIG. 2 such that a passage 46 (FIG. 2) is formed for the hair 14. With the hair 14 threaded through the slip ring 43 as illustrated in FIG. 2, the free end 47 of the hair can be held by the hand, such that the hair 14 is laid within the cavity 32 and stretched therealong in a taut manner.

In this condition of the elements, the cover 37 is then pivotally closed so as to fit the hair 14 into the depression 35, in the closed condition relative to the frog 23 by fitting the slip ring 43 into place, as is shown in FIG. 3. The free end 47 of the hair is thus readily accessible to be cut such that the remainder 48 (FIG. 3) is unobtrusive. The thumb screw 19 is then rotated so as to draw the frog unit 13 away from tip unit 12 and attain the appropriate tautness of the hair 14.

It can readily be appreciated consequently, that should the hair 14 need to be replaced, after removing the present hair and attaching the one end thereof to the tip unit 12 in any contemporary manner, the rear or free end of the new hair comparable to the reference 47 can be quickly, easily and very accurately remounted on the frog unit 13 by the same manner as outlined hereinbefore, wherein excellent control over the cutting of the desired length of the hair is obtained.

I claim:

1. Securing hair to a musical instrument bow having a rod, a tip unit at one end of the rod, and a longitudinally adjustable frog unit having a frog body at the other end of the rod, said frog body being of a type having a longitudinal cavity therein, a transverse depression being formed in the bottom of said longitudinal cavity, a cover pivotally attached to said frog body along a transverse axis with respect to the frog body, said cover having a transversely oriented projection complementary in shape to said transverse depression and means for selectively locking the cover into said longitudinal cavity comprising the steps:

cutting the hair to a length longer than the distance from the tip unit to the frog unit;

securing the hair to the tip unit;

stretching the hair between the frog body and the cover and past the frog unit;

pivoting the cover into the longitudinal cavity and said projection into said transverse depression whereby said hair is clamped between the cover and the frog body;

locking the cover with respect to the frog body to thereby hold the hair in its clamped position; and cutting off the excess hair at the frog unit.

* * * * *